US009945124B2

(12) United States Patent
Baker

(10) Patent No.: US 9,945,124 B2
(45) Date of Patent: Apr. 17, 2018

(54) SHINGLE UNDERLAYMENT SYSTEM INCLUDING A BUILT-IN DRIP EDGE

(71) Applicant: CertainTeed Corporation, Valley Forge, PA (US)

(72) Inventor: Michael S Baker, Downingtown, PA (US)

(73) Assignee: CERTAINTEED CORPORATION, Valley Forge, PA (US)

( * ) Notice: Subject to any disclaimer, the term of this patent is extended or adjusted under 35 U.S.C. 154(b) by 10 days.

(21) Appl. No.: 14/580,954

(22) Filed: Dec. 23, 2014

(65) Prior Publication Data

US 2015/0176282 A1 Jun. 25, 2015

Related U.S. Application Data

(60) Provisional application No. 61/920,060, filed on Dec. 23, 2013.

(51) Int. Cl.

| | |
|---|---|
| ***E04D 13/04*** | (2006.01) |
| ***E04D 5/02*** | (2006.01) |
| ***E04B 1/66*** | (2006.01) |
| ***E04D 12/00*** | (2006.01) |
| ***E04D 1/34*** | (2006.01) |

(52) U.S. Cl.

CPC ..... *E04D 12/002* (2013.01); *E04D 1/3405* (2013.01); *E04D 2001/3435* (2013.01); *E04D 2001/3447* (2013.01); *E04D 2001/3455* (2013.01); *E04D 2001/3476* (2013.01); *E04D 2001/3491* (2013.01); *E04D 2013/0468* (2013.01)

(58) Field of Classification Search

CPC ..... E04D 13/0477; E04D 5/148; E04D 5/02; E04D 13/0459; E04D 2103/06; E04D 2013/0468; E04B 2103/06; E04B 2103/04

See application file for complete search history.

(56) References Cited

U.S. PATENT DOCUMENTS 3,541,745 A * 11/1970 Probst ..... E04D 1/26 52/105
3,691,343 A * 9/1972 Norman ..... E04D 13/103 165/47
5,195,290 A * 3/1993 Hulett ..... E04D 1/26 52/518
5,577,361 A * 11/1996 Grabek, Jr. ..... E04D 1/26 52/543

(Continued)

FOREIGN PATENT DOCUMENTS

CA 2478222 A1 * 3/2005 ..... E04D 5/142

*Primary Examiner* — Joshua J Michener
*Assistant Examiner* — Keith Minter
(74) *Attorney, Agent, or Firm* — Pepper Hamilton LLP

(57) ABSTRACT

A shingle underlayment system includes a waterproofing shingle underlayment, drip edge member, and one or more adhesive sealing strips integrated in a single product. The waterproofing shingle underlayment includes a top surface and an adhesive bottom surface. The drip edge member comprises an in-roof portion and an overhang portion, with the in-roof portion affixed to the top surface of the waterproofing shingle underlayment. The one or more adhesive sealing strips are located above the drip edge member on the top surface of the waterproofing shingle underlayment.

10 Claims, 8 Drawing Sheets

(56) References Cited

U.S. PATENT DOCUMENTS 6,759,630 B1 * 7/2004 Tenute ..... E04D 13/103 219/213
7,954,279 B2 * 6/2011 Covone ..... E04D 13/15 52/58
8,739,470 B1 * 6/2014 Wayne ..... E04D 13/15 52/58
2003/0129899 A1 * 7/2003 Fields ..... B32B 5/02 442/85
2004/0157074 A1 * 8/2004 Hubbard ..... B29C 63/02 428/515
2006/0127627 A1 * 6/2006 Larson ..... E04D 5/10 428/40.1
2007/0042158 A1 * 2/2007 Belt ..... B32B 3/10 428/143
2007/0074466 A1 * 4/2007 Rasmussen ..... E04D 13/0459 52/97
2007/0264471 A1 * 11/2007 Kalwara ..... B29C 65/5057 428/141
2007/0266657 A1 * 11/2007 Gembala ..... E04D 13/15 52/288.1
2010/0287849 A1 * 11/2010 Covone ..... E04D 13/15 52/94
2011/0033685 A1 * 2/2011 Folkersen ..... B32B 11/02 428/219
2011/0197534 A1 * 8/2011 Belt ..... E04D 1/26 52/520
2011/0283646 A1 * 11/2011 Vermilion ..... E04D 1/26 52/539
2013/0025224 A1 * 1/2013 Vermilion ..... E04D 1/26 52/309.2
2013/0025771 A1 * 1/2013 Vermilion ..... B32B 37/24 156/182
2013/0097943 A1 * 4/2013 Higginbotham ..... E04D 13/064 52/12
2013/0157048 A1 * 6/2013 Rudolf ..... C09D 163/00 428/339
2014/0259820 A1 * 9/2014 Humphreys ..... E04D 1/26 40/299.01
2016/0122923 A1 * 5/2016 Faggion ..... E04D 5/02 428/114
2016/0258164 A1 * 9/2016 Canales ..... E04D 5/00
2017/0015083 A1 * 1/2017 Tang ..... B32B 7/00
2017/0081855 A1 * 3/2017 Houchin ..... B32B 7/06
2017/0114542 A1 * 4/2017 Khan ..... C09J 7/0296

* cited by examiner

SHINGLE UNDERLAYMENT SYSTEM INCLUDING A BUILT-IN DRIP EDGE

CROSS-REFERENCE TO RELATED APPLICATIONS

This application claims priority to U.S. provisional application Ser. No. 61/920,060 filed Dec. 23, 2013, which is incorporated herein by reference in its entirety.

TECHNICAL FIELD

The present invention relates generally to a shingle underlayment system which combines a waterproofing shingle underlayment and a drip edge in a single product. Additionally, the present invention includes various methods and apparatuses associated with the shingle underlayment system.

BACKGROUND

When installing a pitched roof on a commercial or residential structure, it is generally recommended that the roof extend beyond the fascia board to allow water to drain into a gutter system. Failure to provide an adequate extension of the roof may cause water to run behind the gutter system, leading to damage of the fascia board and other components of the structure. The conventional technique for extending the roof to the recommended distance is to install a plastic or sheet-metal strip referred to as a "drip edge" at the edge of the roof. This strip attaches directly to the roof and directs water down into the gutter system.

Even with a properly installed drip edge, water may still penetrate the space between the roof and the roof deck. For example, "ice dams" may build up on the gutters and eaves of roofs during freeze-melt cycles and result in trapped water that could penetrate the deck. Additionally, wind may drive water up the slope of a roof, forcing the water under the shingles. To address these issues, a waterproofing shingle underlayment may be installed directly on the roof deck surface. The waterproofing shingle underlayment provides a protective barrier, preventing moisture from contacting the underlying roof deck.

In conventional roofing applications, the drip edge is a device which is separate from the waterproofing shingle underlayment. This results in various cost and time inefficiencies, as the two products must be purchased and installed separately. Additionally, as separate products, there is a risk that the drip edge and the waterproofing shingle underlayment will not be collectively installed in a correct manner, thus reducing their overall effectiveness in moisture prevention. Accordingly, it is desired to create an integrated system which includes both a waterproofing shingle underlayment and a drip edge in a single product.

SUMMARY

Embodiments of the present invention address and overcome one or more of the above shortcomings and drawbacks, by providing methods, systems, and apparatuses related to a shingle underlayment system which includes a built-in drip edge component. The technology is particularly well-suited to be included as part of a roofing system with additional components such as starter shingles, field shingles, and a gutter system. However, it should be noted that the present invention is not limited as such and may be used in various roofing system configurations.

According to some embodiments of the present invention, a shingle underlayment system includes a waterproofing shingle underlayment, drip edge member, and one or more adhesive sealing strips. The waterproofing shingle underlayment includes a top surface and an adhesive bottom surface. The drip edge member comprises an in-roof portion and an overhang portion, with the in-roof portion affixed to the top surface of the waterproofing shingle underlayment. The one or more adhesive sealing strips are located above the in-roof portion of the drip edge member on the top surface of the waterproofing shingle underlayment.

Embodiments of the present invention may further refine one or more of the features in the aforementioned shingle underlayment system. For example, in one embodiment, the drip edge member comprises a fold line indicator located between the in-roof portion of the drip edge member and the overhang portion of the drip edge member. The drip edge member may also include a product identifier presented on an outward facing surface of the drip edge member. For example, the product identifier may include indicia of a manufacturing company, an indication of a manufacturing date, an indication of manufacture location information, or the like. In some embodiments, the drip edge member includes a water diversion structure included on the in-roof portion of the drip edge member. For example, the water diversion structure may be a groove structure or ridge structure extending longitudinally across the in-roof portion of the drip edge member.

The drip edge member included in the aforementioned shingle underlayment system is designed to provide high flexural strength. In some embodiments, the drip edge member is composed of stiff material that also allows rolling of the shingle underlayment system. In one embodiment, the drip edge member is composed of woven material operable to provide stiffness in a direction transverse to a roof line while allowing the shingle underlayment system to be rolled in a longitudinal direction. In another embodiment, the drip edge member is composed of a plurality of slat members operable to provide stiffness of the drip edge member in a direction transverse to a roof line while allowing rolling of the shingle underlayment system in a longitudinal direction. The plurality of slat members may be manufactured, for example, from a plastic-based and/or metal-based material or composition.

Other embodiments of the present invention are directed to a roofing sheet product which includes an ice and water shield and a drip edge strip structure. The ice and water shield includes an in-roof portion and an overhang portion. The drip edge strip structure is adhered to the in-roof portion of the ice and water shield and configured to maintain a substantially rigid form when the in-roof portion of the ice water shield is adhered to a roof deck surface and the overhang portion of the ice and water shield is folded over an edge of the roof deck surface. In one embodiment, the drip edge strip structure includes a fold line indicator indicating a division between the in-roof portion and the overhang portion of the ice and water shield. The substantially rigid form of the drip edge structure may be maintained, for example, by one or more slat elements having a high flexural strength which are embedded in the drip edge structure.

Additionally, embodiments of the present invention are directed to a method of installing a shingle underlayment system which comprises a waterproofing shingle underlayment, a drip edge member, and one or more adhesive strips. The shingle underlayment system is applied to a roof surface in a direction parallel to a roof edge. In one embodiment, applying the shingle underlayment system to the roof surface in the direction parallel to the roof edge is performed by first rolling the shingle underlayment system across the roof surface in the direction parallel to the roof edge. Next, a release sheet is removed from an adhesive backing from an in-roof portion of the shingle underlayment system. Then, the shingle underlayment system is affixed to the roof surface by applying pressure to the in-roof portion of the shingle underlayment system. Once the shingle underlayment system is applied to a roof surface in a direction parallel to a roof edge, an overhang portion of the waterproofing shingle underlayment is folded downward over the roof edge while allowing the drip edge member to extend in a transverse direction with respect to the roof edge parallel (or near parallel) to the roof surface, overhanging the roof edge.

In some embodiments, the aforementioned method of installing a shingle underlayment system includes additional features and/or refinements. For example, in one embodiment, the shingle underlayment system further comprises release tape placed over the one or more adhesive strips and the method further comprises removing the release tape from the shingle underlayment system. In another embodiment, the method includes installing a gutter system over the overhang portion of the waterproofing shingle underlayment. In some embodiments, the release sheet used in the aforementioned method includes a release zone on at least a portion of a bottom surface of the release sheet. In one embodiment, this release zone is in alignment with the one or more adhesive strips and the method further comprises disengaging the release zone from the one or more adhesive strips while unrolling the shingle underlayment system.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION

The following disclosure describes the present invention according to several embodiments directed at methods, systems, and apparatuses related to a shingle underlayment system comprising a waterproofing shingle underlayment with a built-in drip edge component. More specifically, the shingle underlayment system described herein includes a drip edge component attached to the waterproofing shingle underlayment, thus eliminating the need for a separate drip edge device. The various embodiments described herein are applicable to both eave and roof rake applications and may be integrated with various additional roofing components such as, for example, starter shingles, field shingles, and/or a gutter system.

Figure 1:
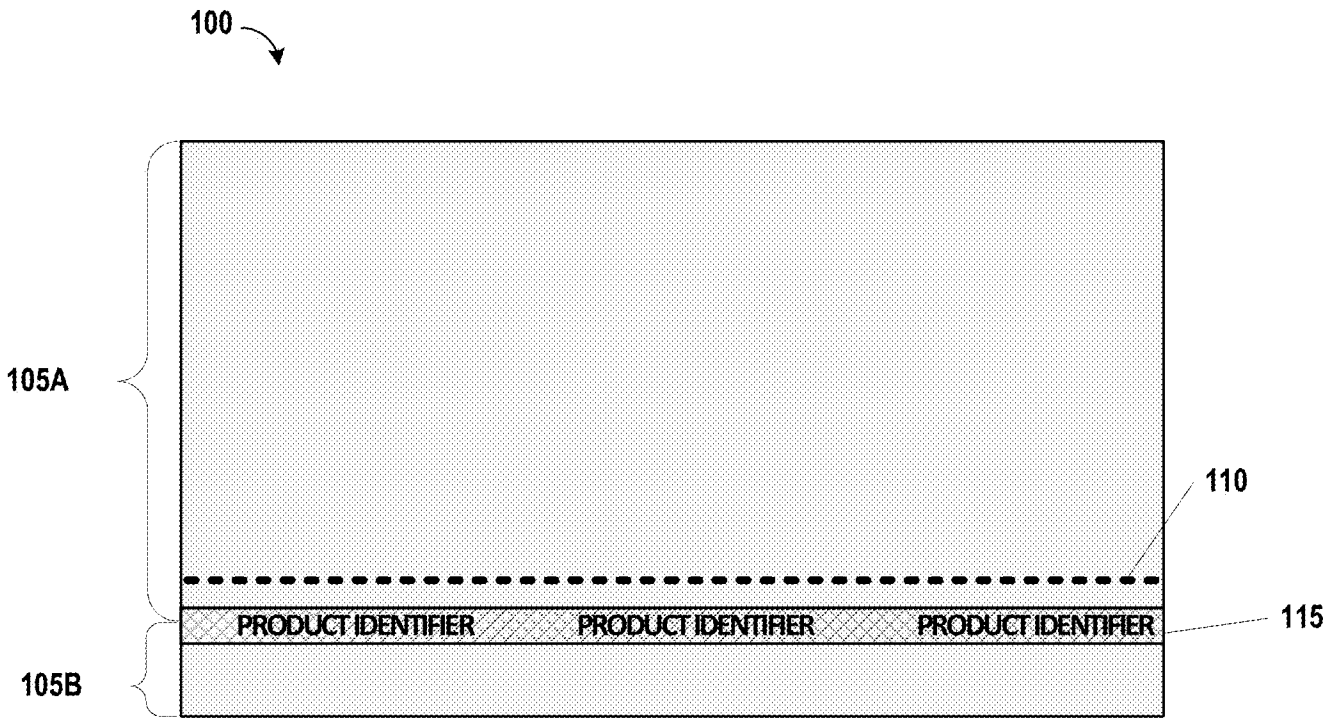
FIG. 1 provides a top surface view of a shingle underlayment system, according to some embodiments of the present invention.

FIG. 1 provides a top surface view of a shingle underlayment system 100, according to some embodiments of the present invention. As shown in the example of FIG. 1, the shingle underlayment system 100 includes a waterproofing shingle underlayment having an in-roof portion 105A and an overhang portion 105B. The in-roof portion 105A is designed to be affixed to a roof deck surface. For example, in some embodiments, the underside of the in-roof portion includes adhesive which bonds the in-roof portion 105A of the waterproofing shingle underlayment to the roof deck. To allow the shingle underlayment system 100 to be rolled, the adhesive on the underside of the in-roof portion may be covered with one or more release zones, for example, in the form of release paper or release film applied over the adhesive. The overhang portion 105B of the waterproofing shingle underlayment is designed to extend over the edge of the roof deck surface and folded down, for example, over a fascia board.

Continuing with reference to FIG. 1, the shingle underlayment system 100 further includes a built-in drip edge component 115. The attachment between the drip edge component 115 and the waterproofing shingle underlayment is such that the drip edge component 115 extends over the roof edge when the overhang portion 105B of the waterproofing shingle underlayment is folded down over the roof edge. For example, in some embodiments, an in-roof portion of the built-in drip edge component 115 is adhesively attached to the in-roof portion 105A of the waterproofing shingle underlayment, while an overhang portion of the built-in drip edge component 115 remains unattached. The built-in drip edge component 115 is described in greater detail below with respect to FIG. 2. Above the built-in drip edge component 115, on the in-roof portion 105A, an adhesive sealing strip 110 extends laterally across the surface of the shingle underlayment system 100 to allow for application of, for example, a starter shingle or roll.

The size of the shingle underlayment system 100 may vary in different embodiments of the present invention, allowing the system 100 to be configured for various roofing applications. For example, in one embodiment, the total width of the system 100 (including the portions 105A and 105B) is 3 feet. This allows 2 feet, 6 inches of the system 100 to remain affixed to the roof deck, while 6 inches extend over the roof edge and down over the fascia board, for example.

Figure 2:
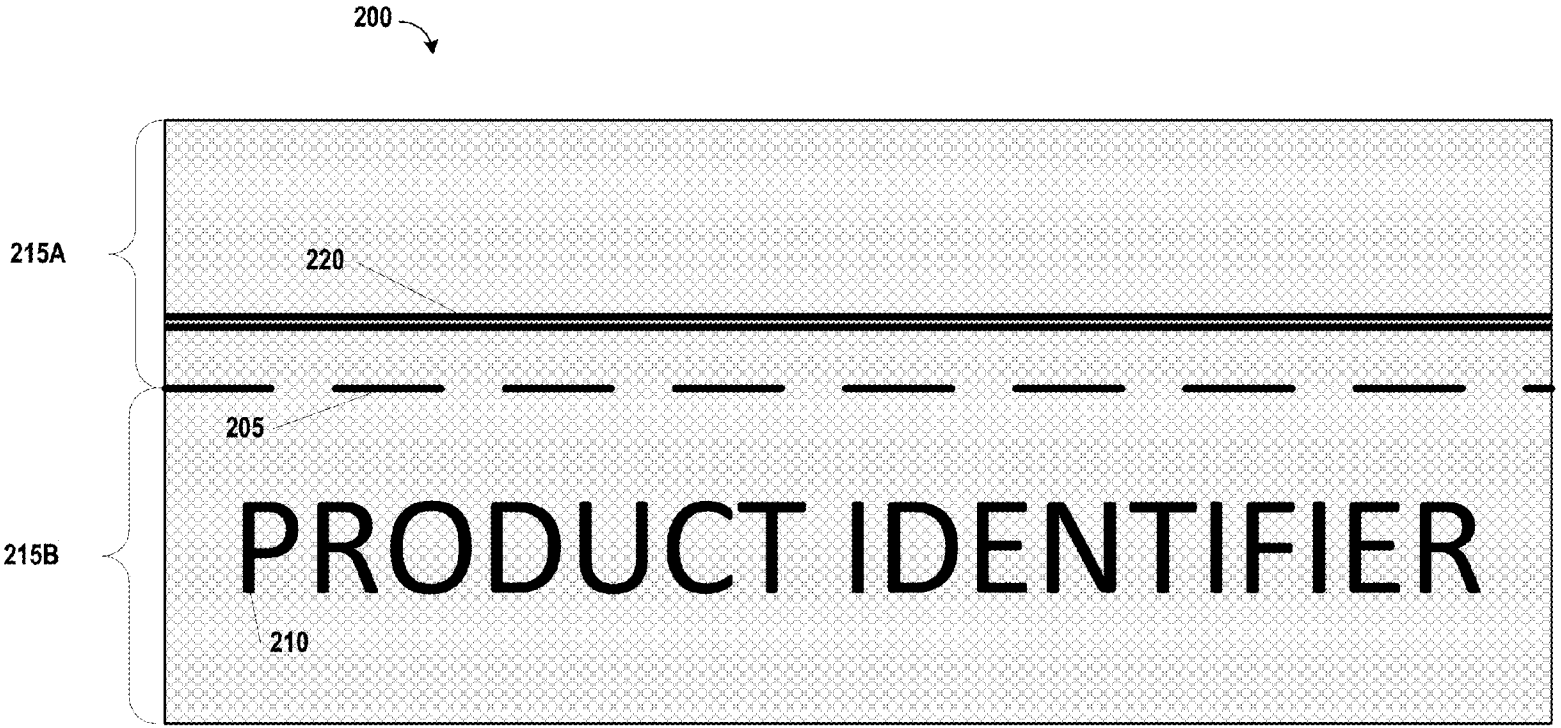
FIG. 2 shows an overhead view of the drip edge component of the shingle underlayment system, according to some embodiments of the present invention.

FIG. 2 shows an overhead view of a portion of drip edge component 200 included in the shingle underlayment system, according to some embodiments of the present invention. The drip edge component 200 includes an in-roof portion 215A and an overhang portion 215B. The in-roof portion 215A is designed to adhere to the waterproofing shingle underlayment included in the shingle underlayment system on the roof surface, while overhang portion 215B remains free (i.e., not attached) for extension over and beyond the roof deck edge. The drip edge component 200 is composed of a rigid or semi-rigid material that provides a greater flexural strength than the shingle underlayment. For example, drip edge component 200 may be manufactured from various metal-based, plastic-based, wood-based and/or composite products, while the shingle underlayment may be a composite material of asphalt polymers. During installation, the overhang portion 215B may be folded in a downward direction, causing an underlying portion of the water proofing shingle underlayment to be folded down, for example, over a fascia board. Then, the rigidity of the drip edge component causes it to separate from the underlying portion of the waterproofing shingle underlayment and return to a position which is substantially parallel to the roof surface. In the example of FIG. 2, a fold line 205 is printed on the top surface of the drip edge component to provide a visual indication for alignment with a roof edge during installation.

In some embodiments, the drip edge component 200 further includes a water diversion structure 220 on the in-roof portion 215A of the component 200. As shown, the water diversion structure 220 extends across the surface of the drip edge component 200 and acts as a water barrier, preventing the flow of water up the roof under the shingles that are applied over it. For example, if water flows up from the overhang-roof portion 215B, it will encounter the water diversion structure 220 and be partially diverted in a lateral direction. Various designs may be used for the water diversion structure 220 within the scope of the present invention. For example, in one embodiment, the water diversion structure 220 is a ridge-like structure extending perpendicular to the upper surface of the drip edge component 200. In other embodiments, the water diversion structure 220 is a groove cut in the upper surface of the drip edge component 200. Various shaped water diversion structures may be used including, without limitation, v-shape, circular shaped, and square shaped structures. The water diversion structure 220 may be manufactured out of various materials such as, for example, metal-based, plastic-based, wood-based and/or composite products. In one embodiment, the water diversion structure 220 is integral with the drip edge component 200.

Continuing with reference to FIG. 2, the built-in drip edge component 200 further includes a product identifier 210 printed on the top surface of the built-in drip edge component 200. It should be noted that printing is only one manner in which the product identifier 210 may be placed on the top surface. For example, in other embodiments, the product identifier 210 may be embossed or debossed on the top surface, or may be engraved or impressed in a different material on the top surface of the built-in drip edge component 200. Additionally, in some embodiments, the color of the product identifier 210 may be selected to create a desired level of visibility (e.g., more or less noticeable with respect to the background) of the product identifier 210 on the top surface of the built-in drip edge component 200. In some embodiments, the product identifier 210 includes indicia of the manufacturer such as the manufacturer's name and/or a logo associated with the manufacturer. In other embodiments, the product identifier 210 includes information regarding the manufacture of the product such as, for example, the location of the manufacturing facility, a date associated with the manufacture of the integrated roofing system, and/or a time associated with the manufacture of the system.

Figure 3:
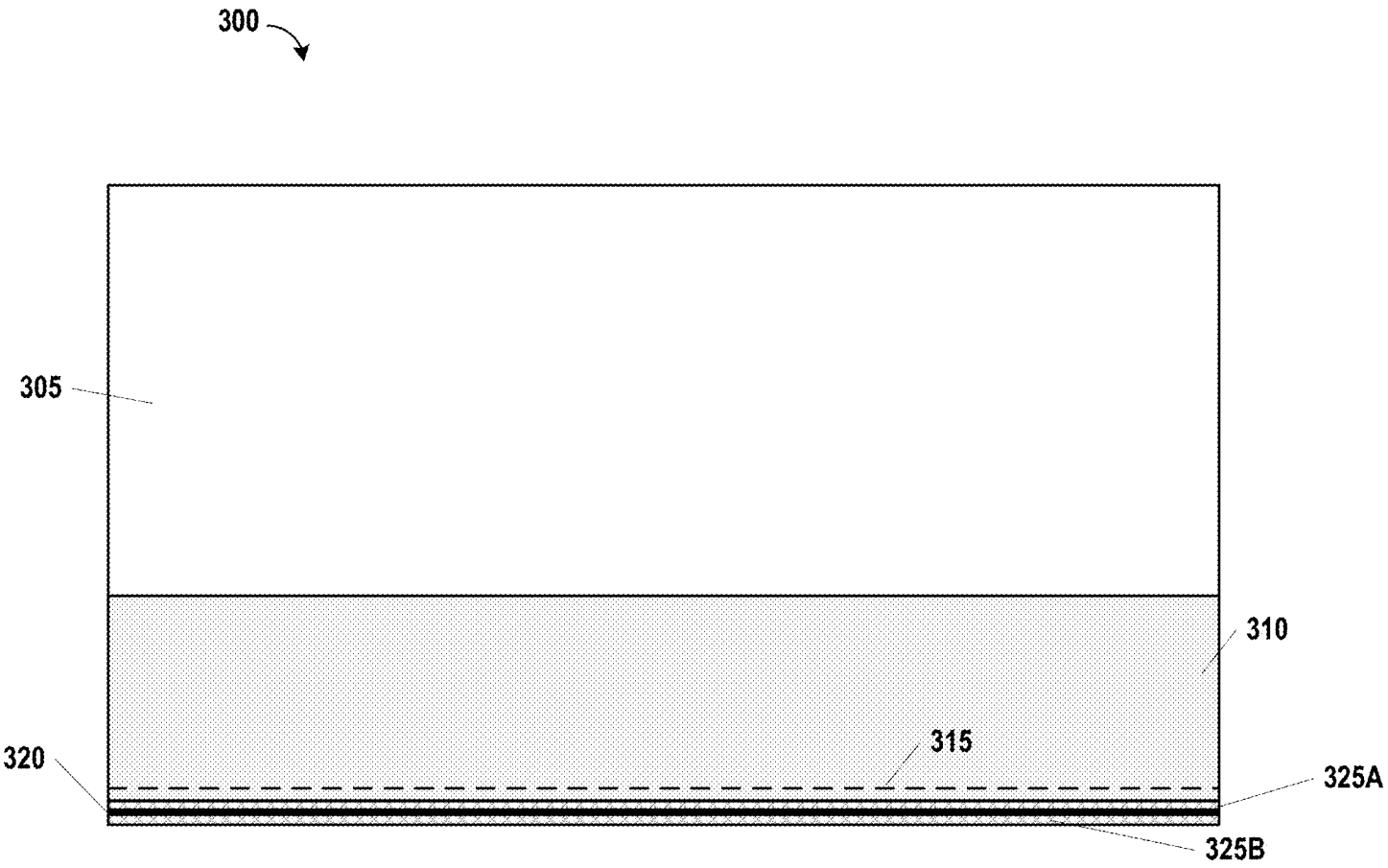
FIG. 3 shows an overhead view of a shingle underlayment system as installed on a roof deck surface, according to some embodiments of the present invention.

FIG. 3 shows an overhead view of a shingle underlayment system 300 as installed on a roof deck surface 305, according to some embodiments of the present invention. In the example of FIG. 3, water proofing shingle underlayment 310 is adhered directly to the roof deck surface 305, for example, using adhesive included on the underside of the underlayment. The waterproofing shingle underlayment 310 corresponds to the in-roof portion 105A of the underlayment shown in FIG. 1. Because FIG. 3 provides an overhead view, the overhang portion of the underlayment 105B of FIG. 1 is not visible in FIG. 3. Adhesive sealant 315 is placed near the edge 320 of the waterproofing shingle underlayment 310 to allow for application of a starter shingle or roll. In some embodiments, the distance between the sealant 315 and the bottom edge 320 is selected to meet building code guidelines associated with roofing applications. Between the adhesive sealant 315 and the roof edge 320, the in-roof portion 325A of a built-in drip edge is adhesively attached to the waterproofing shingle underlayment 310. The overhang portion 325B extends over the roof edge 320.

Figure 4:
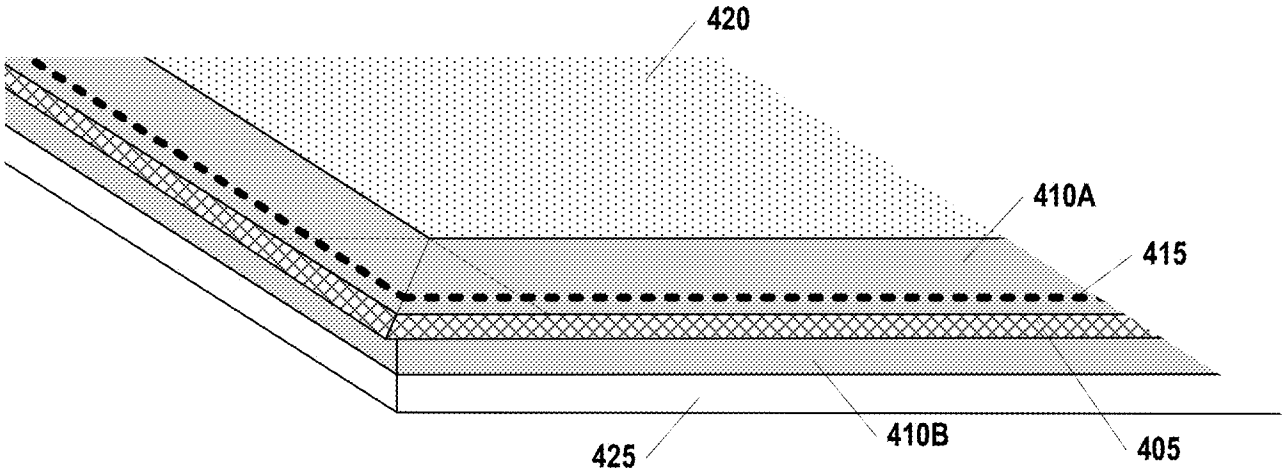
FIG. 4 shows an elevated view of the shingle underlayment system installed on a roof deck, according to some embodiments of the present invention.

FIG. 4 shows an elevated view of a shingle underlayment system installed on a roof deck 420, according to some embodiments of the present invention. In contrast to the illustration of FIG. 3, the illustration of FIG. 4 provides a perspective of how the drip edge component 405 extends outward from the roof edge. As with the example of FIG. 3, an in-roof portion 410A of waterproof shingle underlayment is installed directly on the roof deck 420, while an overhang portion 410B is folded over the roof edge down towards the fascia board 425 underlying the roof. An in-roof portion of the drip edge component 405 is adhered to the waterproof shingle underlayment below a line of adhesive sealant material 415. The overhang portion of the drip edge component 405 extends outward from the roof edge in a direction which is substantially parallel to the roof surface or angled slightly downward from horizontal towards the fascia board 425.

Figure 5A:
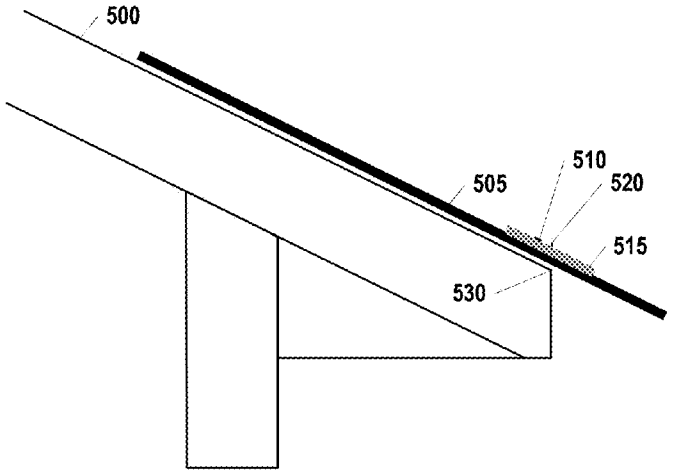
FIG. 5A shows a side view of the shingle underlayment system during installation, according to some embodiments of the present invention.

FIG. 5A shows a side view of the shingle underlayment system during installation, according to some embodiments of the present invention. Waterproofing shingle underlayment 505 is attached to the roof deck surface 500 extending outward over the edge 530 of the roof. A built-in drip edge 515 is attached to the top surface of the waterproofing shingle underlayment with a portion of the drop edge component also extending outward over the roof edge 530. The built-in drip edge 515 includes adhesive material on its top surface to facilitate adhesion to a course of starter shingles or a starter roll (not shown). Optionally, the built-in drip edge 515 may include a water diversion structure 520 located approximately at the edge of the roof. In the example of FIG. 5A, the water diversion structure 520 is a ridge structure constructed, for example, out of a plastic-based material.

Figure 5B:
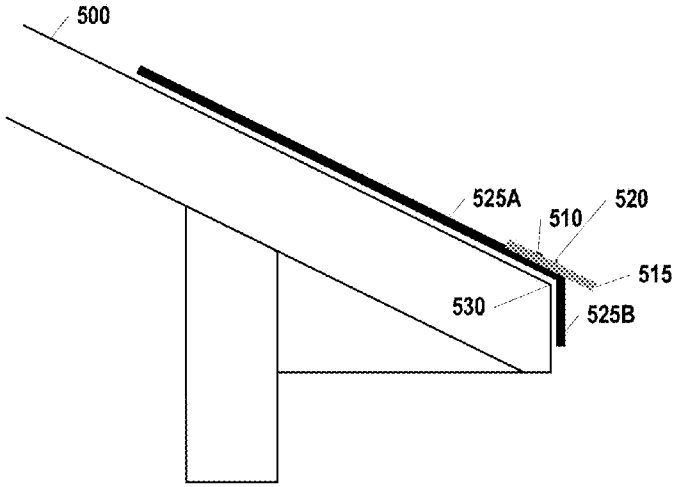
FIG. 5B shows a side view of the shingle underlayment system after installation is complete, according to some embodiments of the present invention.

FIG. 5B shows a side view of the shingle underlayment system after installation is complete, according to some embodiments of the present invention. An in-roof portion 525A of the waterproofing shingle underlayment remains attached to the roof deck 500, while an overhang portion 525B has been folded down over the roof edge 530. The drip edge component 515 remains rigid, extending substantially horizontally to the roof surface or dropping down on a slight angle with respect to the roof deck surface 500. The drip edge component 515 illustrated in FIG. 5B also includes adhesive material 510 and a water diversion structure 520 (optional) on the top surface of the drip edge component 515, showing their placement on the drip edge component 515 with respect to the folded down overhang portion 525B of the waterproofing shingle underlayment.

Figure 6:
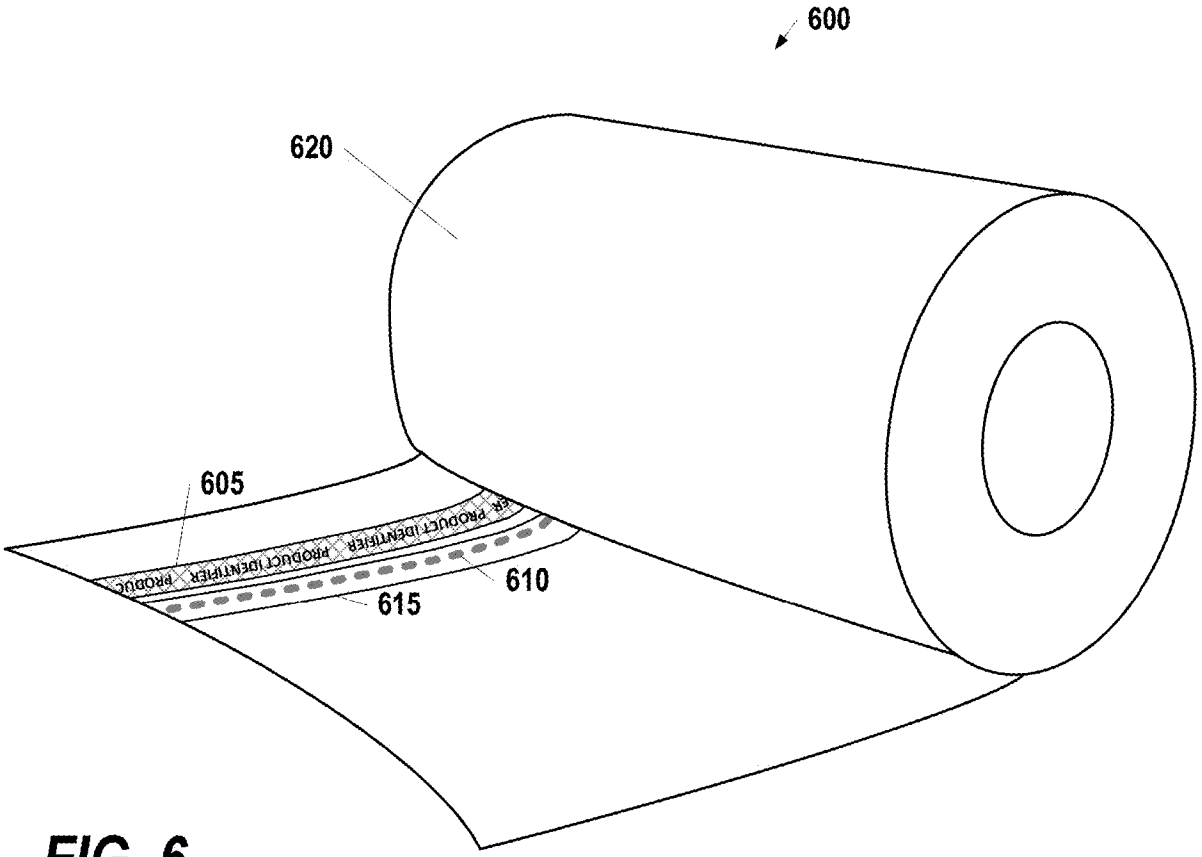
FIG. 6 provides an illustration of how the shingle underlayment system may be provided in a rolled configuration, according to some embodiments of the present invention.

FIG. 6 provides an illustration of how the shingle underlayment system may be provided in a rolled configuration 600, according to some embodiments of the present invention. The rolled configuration 600 is designed to be rolled along a roof edge during installation. The interior of the roll includes the built-in drip edge component 605 and adhesive sealant material 610. To prevent adhesion between adhesive material 610 and the upper surface of the shingle underlayment system while in a rolled configuration 600, a release zone (e.g. release paper) 615 may be provided over the adhesive material 610. Once the integrated roof system has been installed, the release tape 615 may be removed to prepare the waterproof shingle underlayment for adhesion to a course of starter shingles or rolled starter material. In some embodiments, the outer side 620 of the shingle underlayment system may also include adhesive material and a release liner. In these embodiments, release zones may also be provided on the release liner to allow rolling into the configuration 600.

Figure 7A:
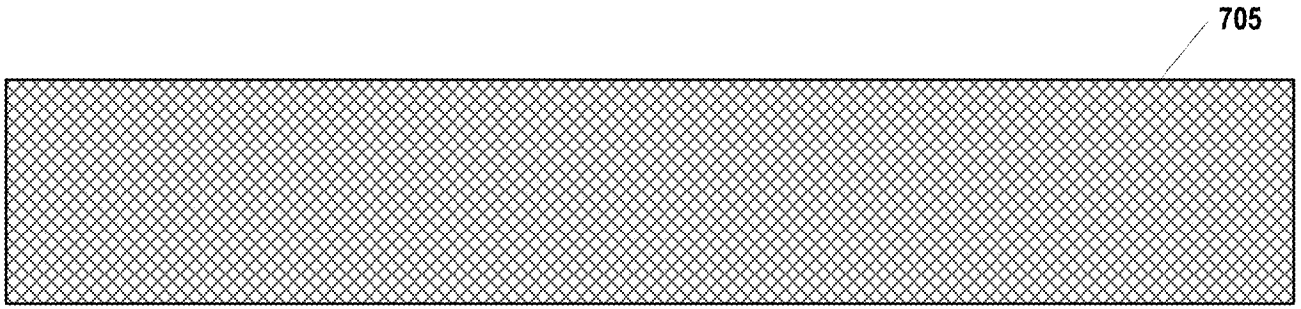
FIG. 7A shows a built-in drip edge constructed of woven material, according to some embodiments of the present invention.
Figure 7B:
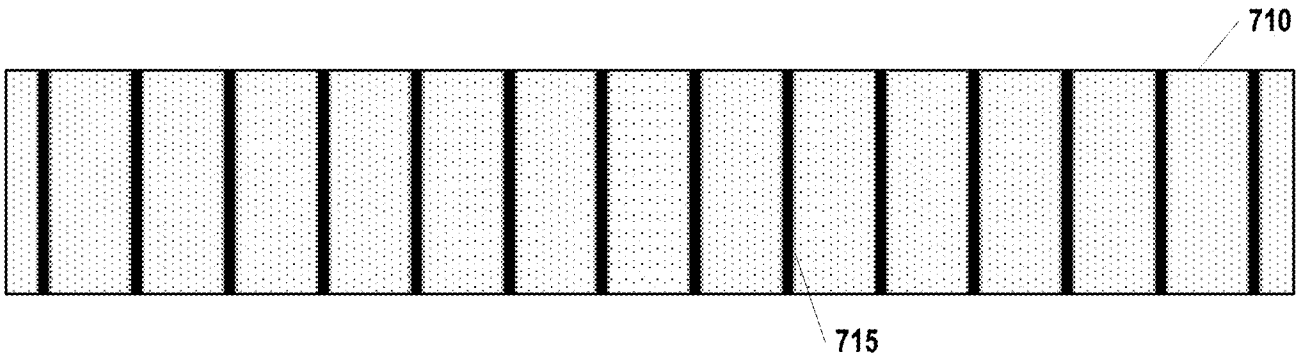
FIG. 7B shows a built-in drip edge where slat elements are provided at equidistant locations along the built-in drip edge component, according to some embodiments of the present invention.

As noted previously, the built-in drip edge component is designed to remain rigid or semi-rigid following installation. Depending on the rigidity of the material used to construct the built-in drip edge, it may be challenging to roll the shingle underlayment system. Thus, in some embodiments, the build-in drip edge component is constructed to facilitate rolling. FIGS. 7A and 7B provide illustrations of how the built-in drip edge may be constructed, according to some embodiments of the present invention.

FIG. 7A shows a built-in drip edge 705 constructed of woven material. This woven material is designed to provide high flexural strength in a lateral direction (i.e. transverse to the roof edge when installed), while providing a lower flexural strength longitudinally (i.e., parallel to the roof edge) to facilitate rolling. FIG. 7B shows an alternate built-in drip edge 710 where slat elements (e.g., 715) are provided at equidistant locations along the built-in drip edge component 710. These slat elements 715 may be constructed of a material with a high flexural strength including, without limitation, plastic-based, wood-based, metal-based and/or composite materials. In some embodiments, the slat elements are embedded in the built-in drip edge during manufacturing. In other embodiments, the slat elements 715 are attached (e.g., via adhesive) to the top or bottom surface of the built-in drip edge after the built-in drip edge is manufactured. The spacing and number of slat elements included in the built-in drip edge may be selected to provide an overall high flexural strength for the built-in drip edge while also allowing rolling. For example, the material used to construct the built-in drip component surface may have a low flexural strength longitudinally to facilitate rolling of the component while the slat elements are spaced such that they do not otherwise interfere with the rolling process.

Figure 8:
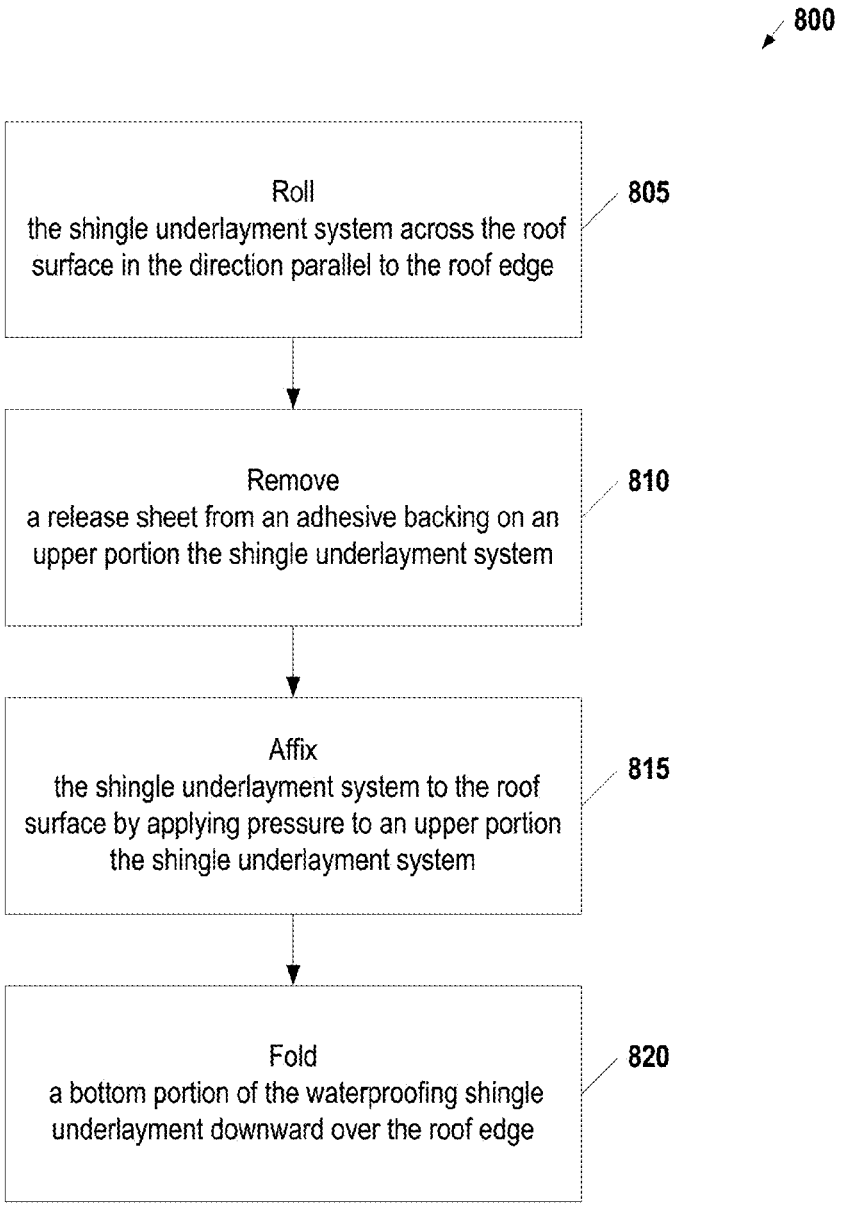
FIG. 8 illustrates a process for installing a shingle underlayment system comprising a waterproofing shingle underlayment, a drip edge member, and one or more adhesive strips, according to some embodiments of the present invention.

FIG. 8 illustrates a process 800 for installing a shingle underlayment system comprising a waterproofing shingle underlayment, a drip edge member, and one or more adhesive strips, according to some embodiments of the present invention. Initially, the shingle underlayment system is applied (e.g., rolled) to a roof surface in a direction parallel to a roof edge. In the example of FIG. 8, this is performed at steps 805, 810, and 815. First, at 805, the shingle underlayment system is rolled across the roof surface in the direction parallel to the roof edge. In some embodiments, the shingle underlayment system includes a fold line indicator. After the shingle underlayment system is rolled across the roof surface, the fold line indicator may be aligned with the roof edge to ensure proper installation of the shingle underlayment system. For example, in some embodiments, the fold line indicator may be located on the drip edge member (see 205 in FIG. 2) such that it provides a recommended division of the in-roof and overhang portion of the shingle underlayment system.

Continuing with reference to FIG. 8, at 810, a release sheet is removed from an adhesive backing on an upper portion the shingle underlayment system. Then, at 820, the shingle underlayment system is affixed to the roof surface by applying pressure to an in-roof portion the shingle underlayment system. Once the shingle underlayment system has been applied to a roof surface, the installation continues at 820 where an overhang portion of the waterproofing shingle underlayment is folded downward over the roof edge while allowing the drip edge member to extend in a transverse direction with respect to the roof edge. Following 820, building materials may be constructed around the shingle underlayment system. For example, in some embodiments, a course of starter shingles or a starter roll is affixed to the top surface shingle underlayment system via the system's adhesive strips (not shown) and/or a gutter system is installed over the overhang portion of the waterproofing shingle underlayment and under the drip edge member (not shown).

In some embodiments, the process 800 described in FIG. 8 may include additional features or variations. For example, in one embodiment, the shingle underlayment system includes release tape placed over the one or more adhesive strips and the process 800 includes removing the release tape from the shingle underlayment system. Similarly, in some embodiments, the release sheet includes a release zone on at least a portion of a bottom surface of the release sheet. In one embodiment, the release zone is in alignment with the one or more adhesive strips and the process 800 includes disengaging the release zone from the one or more adhesive strips while unrolling the shingle underlayment system.

The system and processes of the figures are not exclusive. Other systems and processes may be derived in accordance with the principles of the invention to accomplish the same objectives. Although this invention has been described with reference to particular embodiments, it is to be understood that the embodiments and variations shown and described herein are for illustration purposes only. Modifications to the current design may be implemented by those skilled in the art, without departing from the scope of the invention.

We claim:

1. A shingle underlayment system, the system comprising:

a shingle underlayment roll comprising:

a waterproofing shingle underlayment comprising a top surface and an adhesive bottom surface;

a built-in drip edge member comprising an in-roof portion and an overhang portion, the in-roof portion integrally affixed to the top surface of the waterproofing shingle underlayment; and one or more adhesive sealing strips located above the in-roof portion of the drip edge member on the top surface of the waterproofing shingle underlayment, wherein the shingle underlayment roll is installed by unrolling the shingle underlayment roll along a roof edge with the adhesive bottom surface of the waterproofing shingle underlayment facing toward the roof edge.

2. The shingle underlayment system of claim 1, wherein the drip edge member further comprises a fold line indicator located between the in-roof portion of the drip edge member and the overhang portion of the drip edge member.

3. The shingle underlayment system of claim 1, wherein the drip edge member further comprises a product identifier presented on an outward facing surface of the drip edge member.

4. The shingle underlayment system of claim 3, wherein the product identifier comprises one or more of an indicia of a manufacturing company, an indication of a manufacturing date, and manufacture location information.

5. The shingle underlayment system of claim 1, wherein the drip edge member is composed of woven material operable to provide stiffness in a direction transverse to a roof line while allowing rolling and unrolling of the shingle underlayment system in a longitudinal direction.

6. The shingle underlayment system of claim 1, wherein the drip edge member is composed of a plurality of slat members operable to provide stiffness of the drip edge member in a direction transverse to a roof line while allowing rolling and unrolling of the shingle underlayment system in a longitudinal direction.

7. The shingle underlayment system of claim 6, wherein each of the plurality of slat members is made of a plastic-based composition.

8. The shingle underlayment system of claim 6, wherein each of the plurality of slat members is made of a metal-based composition.

9. The shingle underlayment system of claim 1, wherein the drip edge member further comprises a water diversion structure included on the in-roof portion of the drip edge member.

10. The shingle underlayment system of claim 9, wherein the water diversion structure comprises a groove structure extending longitudinally across the in-roof portion of the drip edge member or a ridge structure extending longitudinally across the in-roof portion of the drip edge member.

* * * * *